United States Patent [19]

Arnolds

[11] 4,254,709

[45] Mar. 10, 1981

[54] INK ROLLER CLEANING DEVICE

[75] Inventor: Karlheinz E. H. Arnolds, Stamford, Conn.

[73] Assignee: Baldwin-Gegenheimer Corporation, Stamford, Conn.

[21] Appl. No.: 651,683

[22] Filed: Jan. 23, 1976

[51] Int. Cl.[3] ..... B41F 35/04

[52] U.S. Cl. ..... 101/425; 101/169; 101/349

[58] Field of Search ..... 101/425, 350, 351, 363, 101/364, 207, 208, 349, 210, 157, 169, 423, 424

[56] References Cited

U.S. PATENT DOCUMENTS

| | | | |
|---|---|---|---|
| 1,531,030 | 3/1925 | Sague | 101/425 |
| 1,689,177 | 10/1928 | Storck | 101/351 |
| 1,772,470 | 8/1930 | Snyder | 101/425 |
| 1,898,361 | 2/1933 | Gollwitzer | 101/351 |
| 2,199,469 | 5/1940 | Seel et al. | 101/425 |
| 2,302,490 | 11/1942 | Curtis | 101/425 |
| 2,341,020 | 2/1944 | Curtis | 101/425 |
| 2,534,670 | 12/1950 | Harrold | 101/364 |
| 2,970,541 | 2/1961 | Gegenheimer | 101/425 |
| 3,848,992 | 11/1974 | Smith | 101/169 X |

*Primary Examiner*—J. Reed Fisher

[57] ABSTRACT

The invention relates to a device for cleaning the ink roller of a printing press. There are two embodiments. There is an ink pan and cleaning blade assembly. The cleaning blade is adapted to engage the ink roller to clean the same. There are mounting brackets attached to the press frame.

There are angle brackets which include saddles adapted to receive flanges on the ink pan and cleaning blade assembly. There are locking levers on the angle brackets having use and non-use positions. When in use the locking lever cooperates with the saddles to lock the ink pan and cleaning blade assembly in position on the angle bracket. When not in use the locking lever is maintained in an out-of-the-way position. There are cam means which cause movement of the angle bracket and hence the ink and pan cleaning blade assembly so that the cleaning blade can contact or not contact the ink roller, as desired.

In one embodiment the cam means causes movement of the angle bracket through a plurality of levers which form with the ink pan and cleaning blade assembly a parallelogram-like structureso that the cleaning blade moves linearly into engagement with the ink roller.

In the other embodiment the angle bracket is pivotally attached to mounting plate and the cam directly engages the angle bracket to cause pivotal movement of the cleaning blade into engagement with the ink roller.

9 Claims, 13 Drawing Figures

FIG.9.
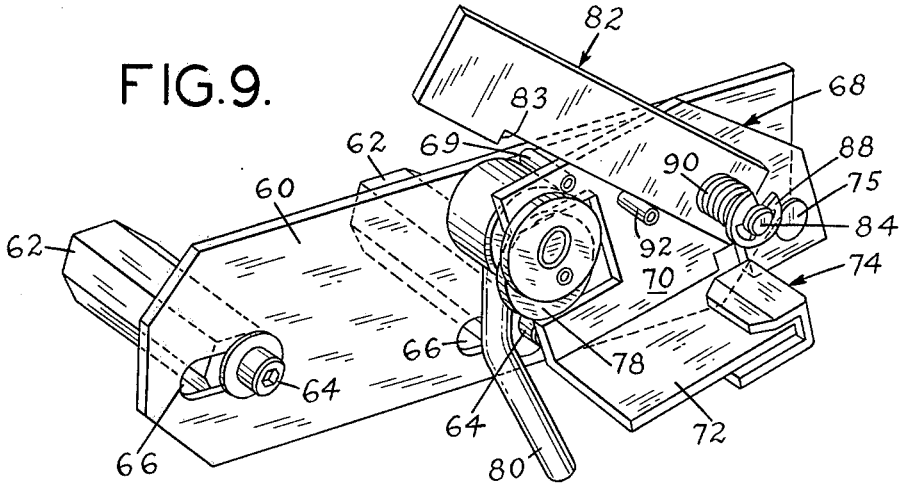
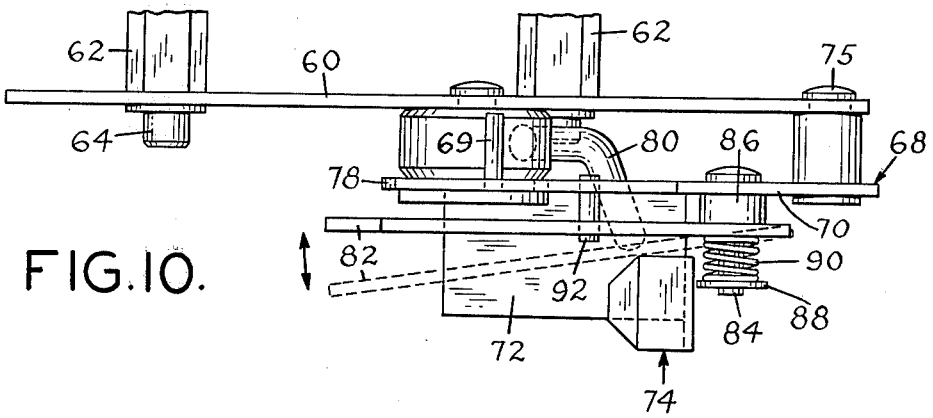
FIG.10.
FIG.11.
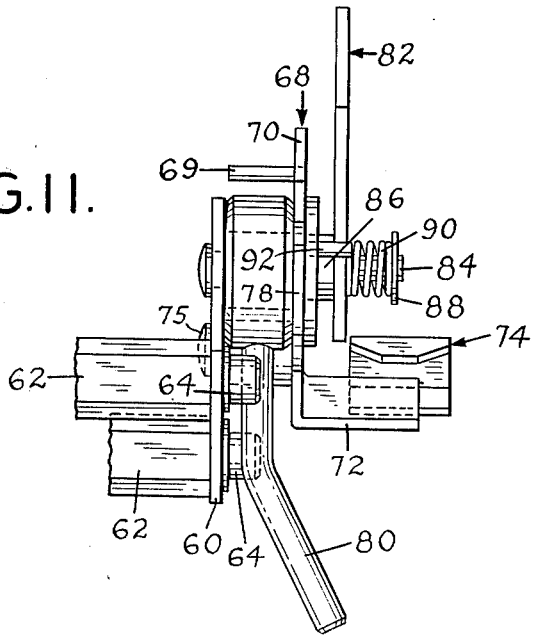

INK ROLLER CLEANING DEVICE

BACKGROUND OF INVENTION

This invention relates to a new improved construction for the cleaning of ink rollers, sometimes referred to as press washers, and more particularly to a new and improved mechanism for cleaning the ink roll of a printing press. In lithographic printing presses it is necessary to clean the ink rollers when the press is shutdown since the ink will become dried on the rollers and affect the quality of subsequent printing. Also from time to time it may be necessary to change the color of ink being used; for this reason it is necessary to clean the ink roll so as to prevent contamination of the new color.

PRIOR ART PRACTICES

Typically, the ink roller has been cleaned through the use of a flexible blade mounted on a mechanism so that the blade is parallel to the ink roller and adapted to be moved into and out of engagement with the ink roller. In addition, it is common practice for solvent to be sprayed on the roller train and a pan is positioned to collect the ink solvent waste mixture scraped off the roller by the blade.

There are numerous different types of constructions for mounting the cleaning blades which have been used and/or are in current use in the printing industry.

One type of mechanism in use is sometimes referred to as the slide with adjusting screw. In this type of mechanism for moving the pan blade assembly includes a slide mechanism which is actuated by a lead screw at each end of the pan assembly with pivots so that the lead screws can be swung out of the way. In this type of construction the blade pressure against the roller is adjusted by rotating the lead screws.

Such devices are generally expensive to build and both slow and difficult to operate. Additionally, it is difficult to remove the pan. Frequently a separate pan is used with this type of device.

Another type of slide device is cam actuated. In this type of mechanism there is a camming surface which causes movement of the flexible blade and its associated structure. Generally, in this type of device a latching mechanism is provided which is attached to the pan. This is undesirable because the latching mechanism can become contaminated when the pan is removed and emptied. This type of mechanism is also expensive.

A very common design can be classified as the pivot and cam design. In this type of mechanism the pan and blade assembly is pivotally mounted on the press frame and is moved into and out of position by cams located at opposite ends of the blade and pan assembly. Frequently, the pan and blade assembly is held in place by gravity and no latching mechanism is used to lock the pan and blade assembly in place. Where a latching mechanism is used, it is generally attached to the pan which leads to the possibility of contamination when the pan is removed and emptied.

A disadvantage of this type of mechanism is that it requires more space than the sliding mechanism described above, and generally the pan and blade assembly is not positively held in the retracted position.

A fourth type of mechanism can be termed a pivot and toggle mechanism. In this type of mechanism a toggle is used to move the pan and blade assembly which is pivotally mounted. The use of a toggle is expensive and this type of mechanism frequently requires the use of a separate pan which adds to the cost.

The present invention uses a novel and relatively simple construction whereby an ink-pan and cleaning blade assembly can be positively locked to a supporting member and then moved into and out of a position of use whereby the flexible cleaning blade engages the ink roller to thereby clean the same. As embodied, the supporting means is in cooperative arrangement with a handle actuated cam which causes movement of the pan and blade assembly towards and away from the ink roller to be cleaned. The invention further includes means for locking the ink pan and blade assembly on the movable member so that the ink pan-cleaning blade assembly is positively locked in position. The latching means is constructed, however, so that the pan and blade assembly can easily and quickly be removed to empty the pan and to permit cleaning of the blade. The invention described herein has two embodiments.

OBJECTS

With the foregoing in mind, it is an object of this invention to provide a new, novel and improved ink roller cleaning mechanism for mounting and moving an ink roller cleaning blade into and out of contact with an ink roller.

A further object of this invention is to provide a new and improved locking mechanism for positively locking the pan and blade assembly to a supporting member which moves toward and away from the ink roller.

Another object of this invention is to provide a new and improved mechanism having either a pivoting or a parallelo-gram-type motion for moving an ink pan and cleaning blade assembly into and out of position with respect to an ink roller to be cleaned by the blade.

A still further object of this invention is a simplified construction for positioning a pan and ink roller cleaning blade with respect to an ink roller.

Another object of this invention is to provide a new and improved mechanism for moving an ink roller cleaning blade into and out of engagement with an ink roller and to provide a latching mechanism which positively locks the ink cleaning blade in both the cleaning position and the retracted position.

A still further object of this invention is to firmly hold and accurately position the ink cleaning blade against the ink roller during the cleaning operation.

Another object of the invention is to eliminate all adjusting screws and mechanism from the pan-blade assembly to eliminate possible contamination thereof when the ink pan is emptied.

A still further object is to provide a mechanism whereby when the ink pan is to be emptied it is simply slid away from the roller to minimize the possibility of accidental spillage resulting in contamination of the roller.

Another object is to provide an ink roller cleaning mechanism which is universal for adaptability to different press designs.

A still further object is to provide an ink roller cleaning mechanism having a rugged construction which operates reliably in service and yet is inexpensive to manufacture.

Additional objects and advantages of the invention will be set forth in the description which follows and in part will be obvious from the description the objects and advantages being realized and obtained by means of the instrumentation, parts and apparatus particularly pointed out in the appended claims.

BRIEF DESCRIPTION OF THE INVENTION

Briefly described the invention comprises a mounting plate for adjustably mounting the ink roller cleaning mechanism with respect to the printing press. In the first embodiment attached to the mounting plate are first and second levers or links, one of which is slotted to receive a cam member. The first and second levers or links are interconnected by an angle bracket or link attached to the ends of the first and second link to thereby form a parallelogram-type structure. The interconnecting link or angle bracket includes a flange forming a shelf or saddle for receipt of a flange on the ink pan and cleaning blade assembly.

A cam having an actuating lever is pivotally attached to the mounting plate so that the cam extends into the slot in the first lever. Hence movement of the lever will cause rotation of the cam and movement of the parallelogram linkage.

The invention further includes a latch means or locking means in the form of a lever adapted to be moved into locking engagement with the edge of the ink pan and cleaning blade assembly so that the ink pan is releasably but positively held in position and moves with the parallelogram linkage.

In a second embodiment the structure has been simplified somewhat in that the locking mechanism including the saddle and the locking lever is mounted on a pivoted angle bracket which has a slot therein for receipt of a cam means which causes movement of the pan and blade mechanism carried thereby towards and away from the roller to be cleaned.

In each embodiment when the ink pan is to be cleaned the pan and blade assembly are moved to the retracted position and the pan can be simply slid out of the way thereby reducing the possibility of accidental spillage.

The invention consists of the novel parts, steps, construction and improvements shown and described.

The accompanying drawings which are incorporated in and constitute part of this specification illustrate an embodiment of the invention and together with the description serve to explain the principles of the invention.

Of the drawings

FIG. 9 is a perspective of another embodiment of the invention with the device in the starting position with the tray not in use.

FIG. 10 is a plan view of the device shown in FIG. 9.

FIG. 11 is an end view of the device shown in FIG. 9.

DETAILED DESCRIPTION OF THE INVENTION

A detailed description of the invention with specific reference to the drawings is set forth below.

Figure 1:
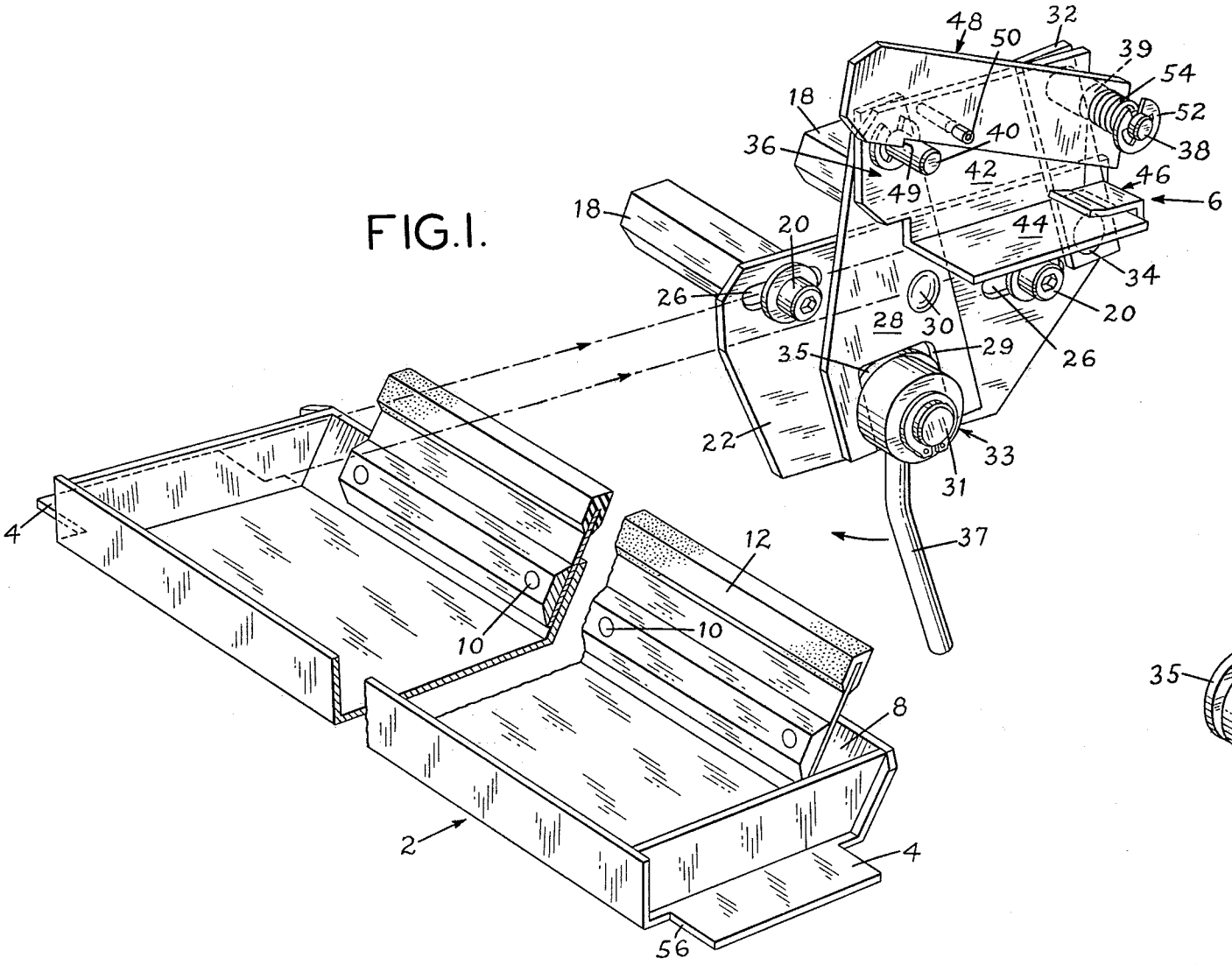
FIG. 1 is a perspective showing of the ink pen before being attached to the pan and blade moving mechanism and showing the latch in the non-use position.
Figure 2:
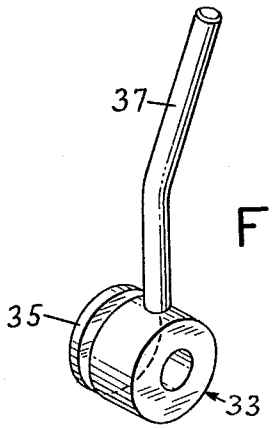
FIG. 2 is a perspective drawing of the actuating cam and lever.
Figure 8:
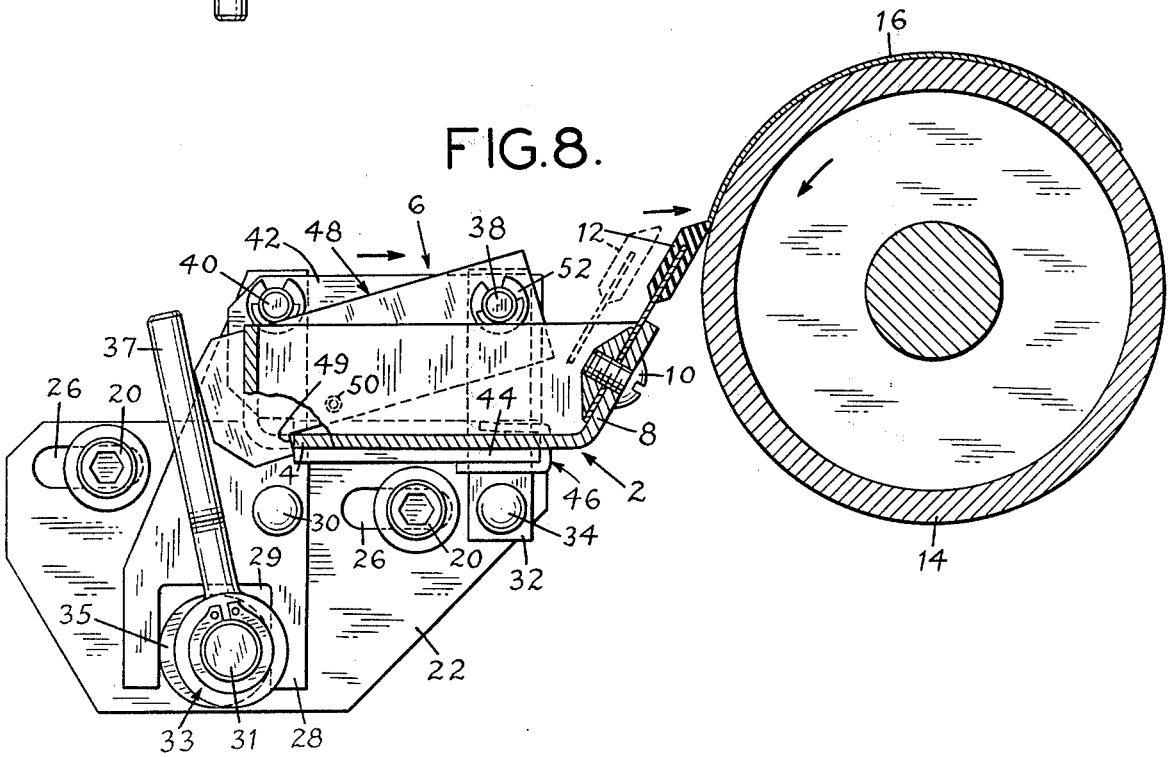
FIG. 8 is a vertical section taken along line 8—8 of FIG. 4.

As shown in FIG. 1 there is an ink collecting tray or pan 2 having outer holding flanges 4 at each end thereof. The holding flanges cooperate with the parallelogram mechanism (shown generally at 6) to help maintain the ink pan and blade in position. Attached to one side 8 of the ink pan 2 by any convenient means such as screws 10 is a flexible blade 12. The flexible blade 12 can be made of rubber, for example, and is conventional in nature and can be of the type generally described in U.S. Pat. Nos. 3,601,051 and 2,970,541. As can be seen in FIG. 8 when the blade 12 is in engagement with the ink roller 14, the blade removes the ink solvent mixture 16 from the ink roller which mixture will then fall into the ink pan 2.

Figure 3:
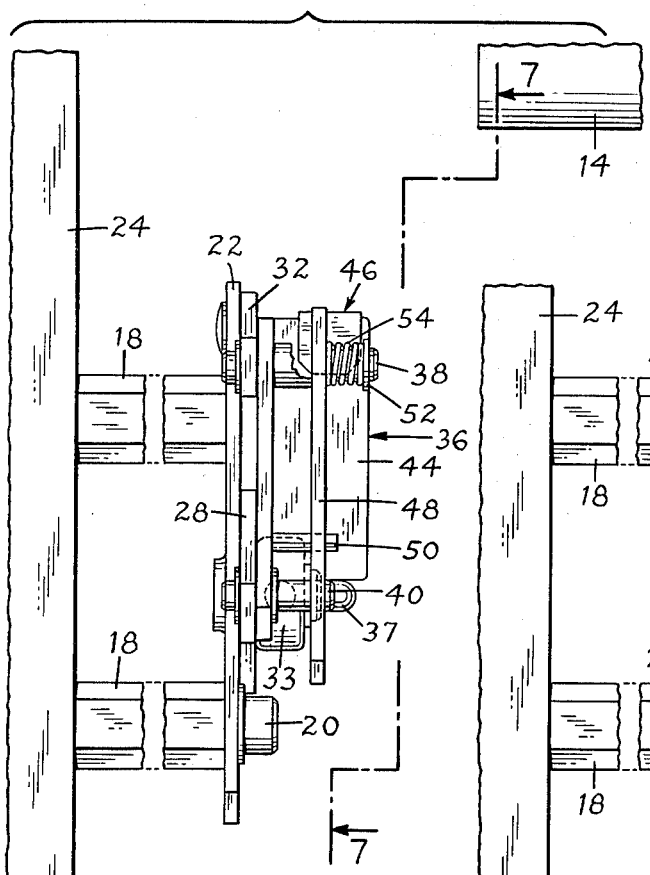
FIG. 3 is a plan view of the pan and blade moving assembly mechanism showing the locking latch resting on a stud in the non-use position.

Referring again to FIG. 1 there is shown internally threaded hexagonal spacers 18 which cooperate with bolts 20 to attach the mounting plate 22 with respect to the press frame 24 (see FIG. 3). Means are provided so that the mounting plate is adjustably positioned with respect to the ink roller (FIG. 8). This means is the oblong openings 26 in the mounting bracket in combination with the threaded bolts 20. With this construction, as the flexible blade 12 wears down through use the entire mechanism can be moved closer to the ink roller so that proper contact between the ink roller and the flexible blade is maintained.

In accordance with this embodiment of the invention means is provided for pivotally mounting an ink pan locking means for a pan-blade assembly with respect to a mounting plate and cam means for moving said pan-blade assembly towards and away from a roller to be cleaned.

More specifically, the mechanism consists of a first link or cam bracket 28. This first link or cam bracket is pivotally attached to the mounting plate 22 by a rivet 30 or other convenient means. There is a second link 32 pivotally attached at one end to the mounting plate 22 by means of a rivet 34 or other convenient means.

In accordance with this invention means is provided for causing movement of the first link or cam bracket and hence movement of the parallelogram-type linkage. As embodied, the cam bracket or link 28 has a cam receiving slot 29 therein. Mounted on the stud 31 is a cam member 33 having a cam surface 35 at one end thereof which is positioned within the slot 29. A handle 37 is attached to the cam member 33 so that movement of the handle will cause movement of the cam 35 and cause the first link or cam bracket to pivot about the rivet 30.

The first and second links are pivotally attached to a third link or angle bracket 36 by means of the studs 38, 40.

The angle bracket 36 consists of a vertical section 42 and a horizontal section 44. Welded or otherwise suitably attached to the horizontal section 44 of the angle bracket 36 is a shelf means or saddle 46. The function of the saddle 46 will be explained subsequently.

The shelf means or saddle 46 are in cooperative engagement with the flanges 4 on the ink pan in a manner whereby the flanges 4 fit under the saddle 46 to thereby position the pan and blade assembly on the parallelogram assembly in at least one direction.

In accordance with this invention locking means are provided to lock the pan and blade assembly on the angle bracket and the parallelogram assembly. As embodied, this means includes a locking lever 48 having a notch 49 pivotally mounted on the stud 38 which cooperates with saddle 46 to lock the pan-blade assembly in place.

The locking lever 48 is mounted on the stud 38 so that it can move along at least a portion of the length of the stud 38. Movement of the locking lever 48 towards the vertical wall 42 of the angle bracket is limited by the stop pin 50 which is mounted on the locking lever 48 in any convenient fashion and the shoulder 39 on the stud 38.

Attached at the end of the stud 38 is a lock washer 52 and positioned between the lock washer 52 and the locking lever 48 is a spring 54 which urges the locking lever towards the angle bracket 36.

The stud 40 which is fixedly attached to the first link or cam bracket 28 and extends through an opening in the vertical wall 42 of the angle bracket 36. As can be seen in FIG. 1, or example, when the locking lever is in the non-use position it rests on the stud 40. Thus the locking lever 48 when not in use is kept out of the way so that the pan and blade assembly can be slid under hold-down or saddle member 46 without interference with the locking lever. After the pan and blade assembly has been slid into place on the parallelogram assembly the locking lever can be placed in locking engagement with the end of the pan opposite from the cleaning blade.

Figure 4:
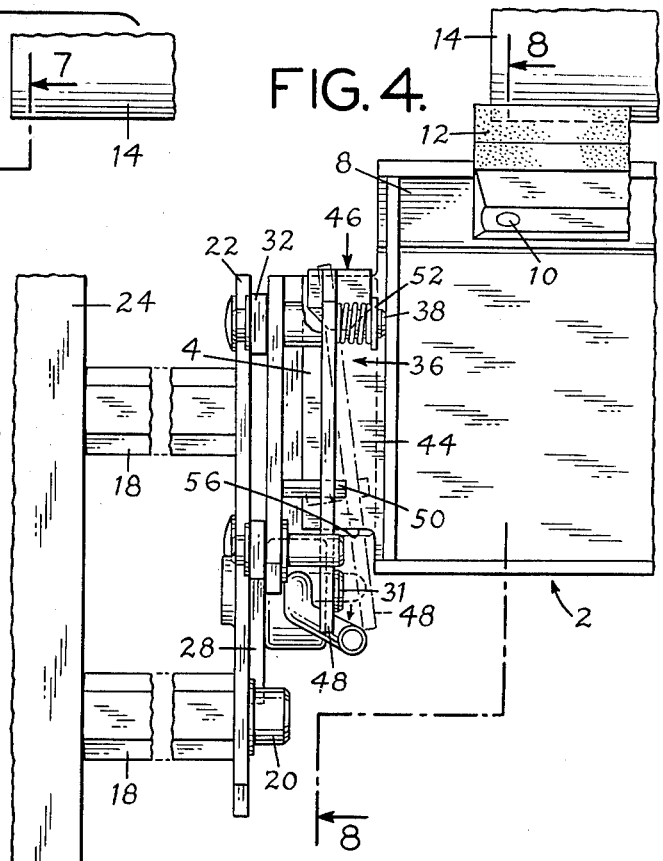
FIG. 4 is a plan view, similar to FIG. 3, showing the locking latch in locking position.
Figure 5:
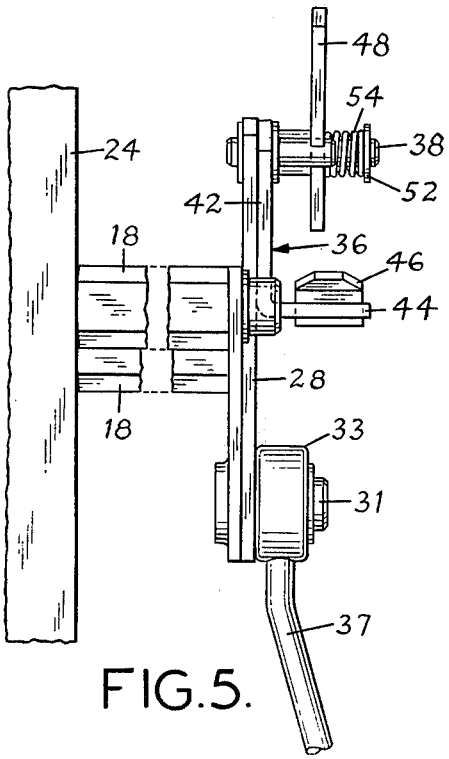
FIG. 5 is a front view of the mechanism shown in FIG. 3.

The locking lever is moved into locking position by moving the free end sufficiently away from the angle bracket 36 until it clears the end of the stud 40 (see FIG. 4, dot-dash illustration). The locking lever it then moved downwardly until it is below the stud 40 and then inwardly, i.e., towards the angle bracket 36, and the notch 49 is placed into engagement with the rear edge 56 of the flange 4 on the ink pan and blade assembly. In this way the ink pan and blade assembly is maintained in a locked position by the combination of the locking lever 48 and the saddle 46. Thus, the ink pan and blade assembly when in the locked position will move together toward and away from the roller.

It is to be understood that there are two parallelogram-type (with associated structures) mechanisms attached to the press frame at opposite ends of the ink rollers. Other than the fact that these mechanisms and structures are located at opposite ends of the ink roller, they are identical.

OPERATION

The operation of this embodiment of the invention will be readily understood from the following description.

With cam member 33 and lever or handle 37 in the position shown in FIGS. 1, 3, 5, and 7, the locking lever is resting on the stud 40 and the parallelogram mechanism is in the retracted position the blade is, therefore, positioned away from the ink roller (FIG. 8, dotted lines).

Figure 6:
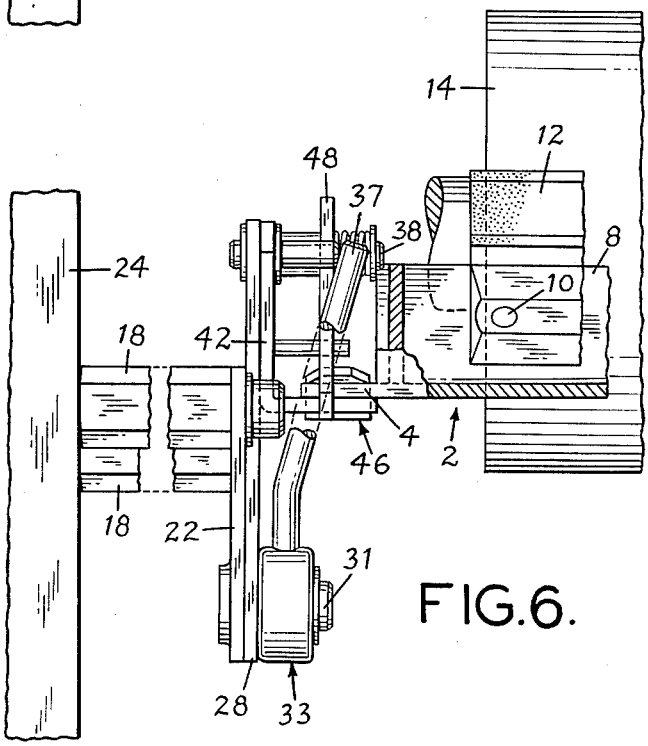
FIG. 6 is a front view of the mechanism shown in FIG. 4.
Figure 7:
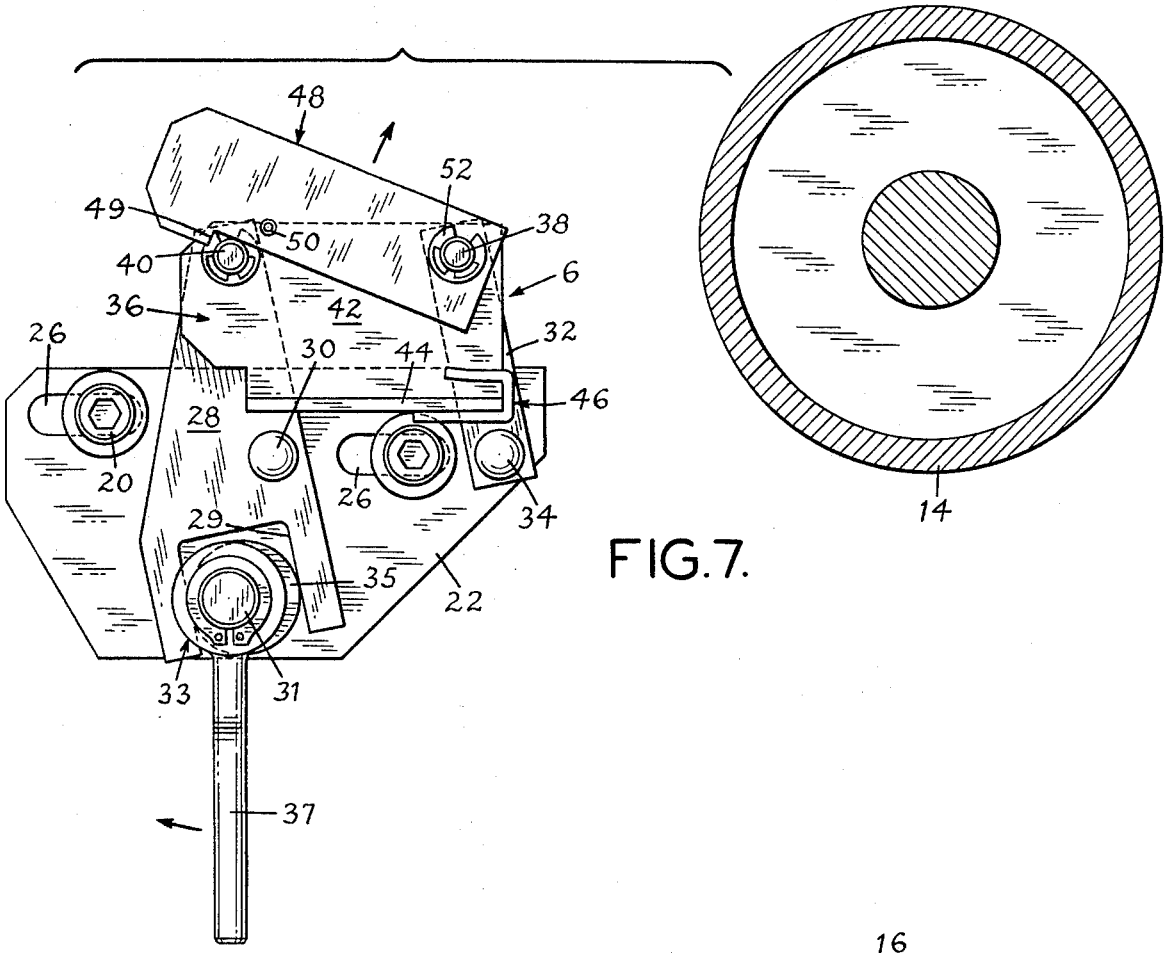
FIG. 7 is a vertical section taken along line 7—7 of FIG. 3.

The pan and blade assembly is then placed on the angle bracket and under the saddle 46 and the locking lever 48 manipulated into locking position as shown in full line in FIGS. 4, 6 and 8. When it is desired to clean the ink roller the cam handle 37 is moved to upward position (FIG. 8) which causes the cam 35 to move in the slot 29 which in turn causes the pan and blade assembly to move linearly toward the ink roller until the blade 12 is in contact with the ink roller. As the ink roller rotates, the blade will scrape the ink from the roller as shown in FIG. 8 (full line).

When the press is printing the cam handle 37 is moved to the down position (FIGS. 1 and 7) and the pan and blade assembly moves to the retracted position (FIG. 8, dotted line).

If the pan becomes full of ink, the locking lever 48 is released from its position engagement with the flanges 4 of the pan and is positioned on top of the stud 40. The pan and blade assembly can then be removed and emptied and, if necessary, the blade cleaned.

FIGS. 9–12 illustrate a simplified version of the present invention.

One of the features of this embodiment of the invention is its simplicity and yet this embodiment retains many of the novel and beneficial features of the embodiment illustrated in FIGS. 1–8.

In this embodiment there is a mounting plate 60 attached to the press by means of internally threaded hexagonal spacers 62 which cooperate with bolts 64 to position the mounting plate with respect to the press in the same manner as in the embodiment of FIGS. 1–8. Also as in the embodiment of FIGS. 1–8, the bolts 64 extend through oblong openings 66 in the mounting plate 60 so that the mounting plate is adjustably mounted permitting the entire mechanism to be moved towards and away from the printing roll.

In accordance with this embodiment of the invention means is provided for pivotally mounting an ink pan latching mechanism with respect to the mounting plate.

As embodied this means comprises an angle bracket 68 consisting of a vertical section 70 and a horizontal section 72. Welded or otherwise suitably attached to the horizontal section 72 of the angle bracket 68 is a U-shaped clamping means or saddle 74.

The angle bracket is pivotally attached to the mounting plate 60 by means of a rivet 75.

Means is provided for causing pivotal movement of the ink pan assembly so that the flexible blade can be moved into or out of engagement with the ink roller.

As embodied, this means comprises a cam 78 rotatably attached to the mounting plate 60 in any convenient fashion. Attached to the cam 78 is a handle 80 used to cause rotation of the cam member. There is a stop 69 which limits movement of the handle 80.

As in the first embodiment, this embodiment of the invention includes a locking lever 82 having a notch 83 which is pivotally attached to the angle bracket 68 by a stud 84. The locking lever 82 is spaced from the angle bracket 68 by a spacer member 86. There is a lock washer 88 at the free end of the stud 86. Positioned between the lock washer 88 and the locking lever 82 is a spring 90.

Figure 12:
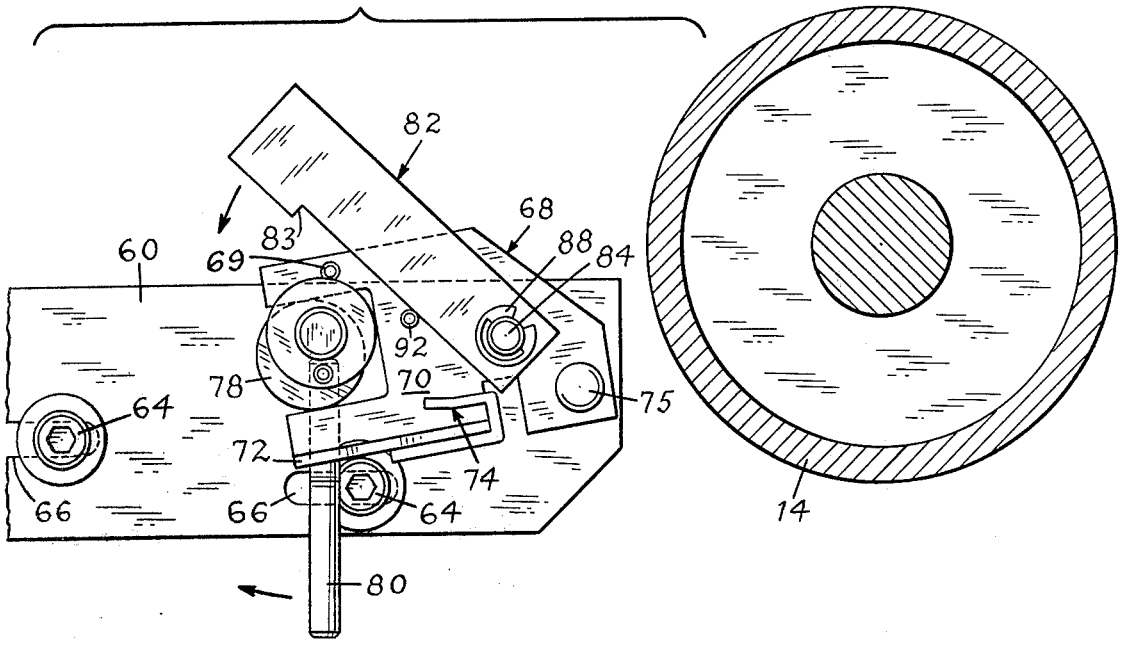
FIG. 12 is a side view showing the starting position of the device and the print roll with the tray not in use.

The vertical wall 70 of the angle bracket further includes a stud 92 on which the locking lever 82 rests when in the non-use position (see FIG. 9 and FIG. 12).

OPERATION

The operation of this embodiment is very similar to the operation of the device shown in FIGS. 1–8.

As shown in FIG. 9 and FIG. 12 when not in use the locking lever 82 rests on the stud 92. When it is desired to use the ink pan cleaning blade assembly, the edges 4 of the pan are positioned under the saddle 74. The locking lever 82 is then moved away from its position of rest on stud 92, as shown in the dotted line of FIG. 10. The locking lever is then lowered and the notch 83 is placed in engagement with the edge 56 of the ink pan 2 (see FIG. 13).

Figure 13:
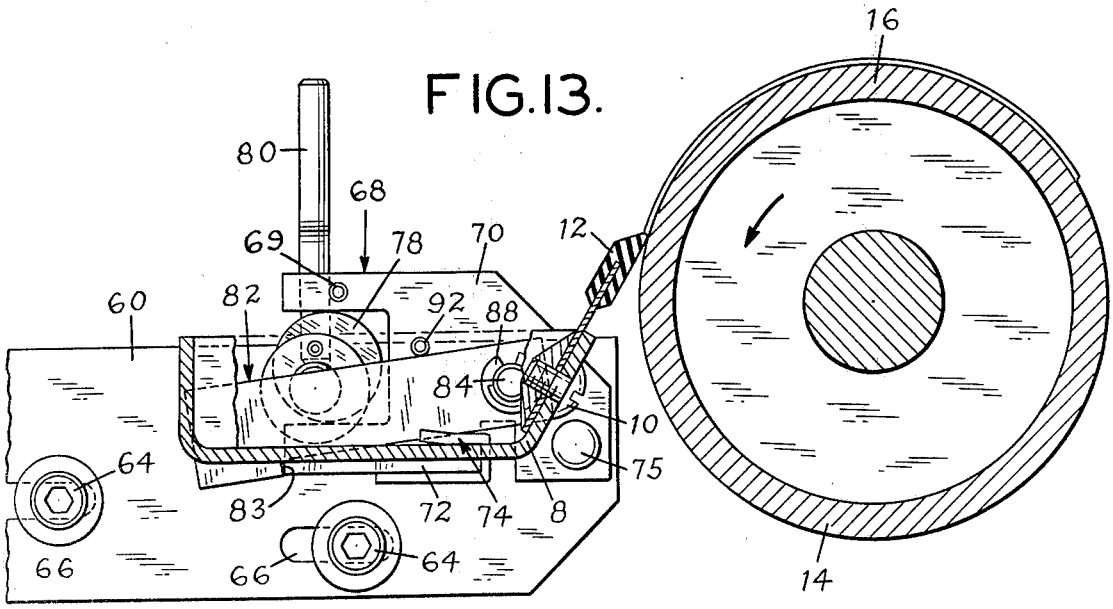
FIG. 13 is a side view, similar to FIG. 12 showing the device moved closer to the print roll with the flexible blade in contact with the roll and the tray in position.

When it is desired to move the cleaning blade into engagement with the roller the handle 80 is moved from the down position of FIG. 12 to the up position of FIG. 13. This movement causes rotation of the cam and pivotal movement of the angle bracket 68 about the pivot point 75. All during this movement the ink-pan cleaning blade assembly are positively locked to the angle bracket. Similarly, when the handle 80 is moved from the FIG. 13 position to the FIG. 12 position, the ink pan and flexible blade assembly is moved away from the ink roller but remains in the locked position.

When the ink pan needs cleaning or emptying it is a simple matter to unlock locking lever 82 and then slide the ink pan and flexible blade assembly away from the angle bracket. This simple movement substantially eliminates the possibility of accidental spillage.

It will be understood that as in the case of the previous embodiment there are two such latching mechanisms attached to the press frame at opposite ends of the roller and the pan and blade assembly extends between such latching mechanisms.

What is claimed is:

1. A device for cleaning an ink roller on a printing press comprising:

(a) a pan and cleaning blade assembly;

(b) a pair of mounting plates attached to the frame of the printing press;

(c) a pair of angle brackets movably attached to said mounting plates;

(d) a pair of saddle means on said angle brackets adaptable to receive one flange of said pan and cleaning blade assembly so that the pan and cleaning blade assembly can extend between the frame of the press and be positioned adjacent the ink roller;

(e) a pair of locking levers pivotally attached to said angle brackets and adapted to engage the pan and cleaning blade assembly to thereby lock the pan and cleaning blade assembly with respect to said angle brackets;

(f) means for moving said angle brackets toward and away from said ink roller so that the cleaning blade can be engaged and disengaged with said ink roller.

2. A device as defined in claim 1 wherein said means for moving said angle brackets includes a pair of cams rotatably attached to said mounting plates.

3. A device as defined in claim 2 wherein said angle brackets are pivotally attached to said mounting plates and wherein said cam means extends into slots in said angle brackets so that upon actuation of said cam means the pan and cleaning blade assembly pivots towards and away from said ink roller.

4. A device as defined in claim 2 wherein said angle brackets are pivotally attached to said mounting plates and wherein there are first and second lever means pivotally attached at one end to the mounting plate and at the other end to said angle brackets to form thereby a parallelogram-type structure, said first levers having a slot therein for receipt of said cam means, whereby actuation of said cam means causes linear movement of said pan and cleaning blade assembly towards and away from the ink roller.

5. A device as defined in claim 1 having studs on said angle bracket for maintaining said locking levers in a non-use position when desired.

6. A device for cleaning an ink roller on a printing press comprising:

(a) an ink pan and cleaning blade assembly;

(b) a pair of mounting brackets attached to the frame of a printing press;

(c) a pair of first levers pivotally attached to said mounting brackets;

(d) a pair of second levers pivotally attached to said mounting brackets;

(e) a pair of angle brackets pivotally connected to one end of said first and second levers;

(f) means on said angle brackets for engaging said pan and blade assembly so that said pan and blade assembly extends between said mounting brackets;

(g) a pair of locking levers adapted to engage the ink pan and blade assembly to thereby releasably lock said ink pan and blade assembly on said angle brackets;

(h) a pair of cams mounted on said mounting brackets and cooperating with said first pair of levers so that movement of said cams will cause movement of said pan and blade assembly towards and away from the ink roller.

7. A device for cleaning the ink roll of a printing press comprising:

(a) an ink pan and cleaning blade assembly;

(b) a pair of mounting plates attached to the frame of a printing press;

(c) a pair of angle brackets pivotally attached to said mounting plates;

(d) receiving means on said angle brackets for receiving said ink pan and cleaning blade assembly;

(e) means including a lever pivotally mounted with respect to said angle brackets and cooperating with said receiving means to releasably lock said ink pan and cleaning blade assembly in position; and (f) means including a cam in cooperative relationship with said angle brackets to move said ink pan and cleaning blade assembly into and out of cleaning position.

8. A device as defined in claim 7 wherein each of said angle brackets has a vertical portion pivotally attached to a respective one of said mounting plates and a horizontal portion including saddle means for receiving one edge of the ink pan and cleaning blade assembly.

9. A device as defined in claim 8 wherein each said vertical portion includes a slot and wherein said means to move includes two cams, one cam being mounted in each said slot.

* * * * *